United States Patent [19]

Eldin et al.

[11] 4,144,120

[45] Mar. 13, 1979

[54] METHOD FOR TREATING PAPER WITH A COMPOSITION CONTAINING HYDANTOIN COMPOUNDS AND A COPOLYMER

[75] Inventors: Sameer H. Eldin, Birsfelden; Wolfgang Seiz, Pfeffingen; Ewald Forster, Allschwil, all of Switzerland

[73] Assignee: Ciba-Geigy Corporation, Ardsley, N.Y.

[21] Appl. No.: 806,425

[22] Filed: Jun. 14, 1977

[30] Foreign Application Priority Data

Jun. 25, 1976 [CH] Switzerland ..... 8159/76

[51] Int. Cl.[2] ..... D21H 1/48

[52] U.S. Cl. ..... 162/136; 162/158; 162/168 R; 427/369; 427/391; 427/395; 428/530; 428/537

[58] Field of Search ..... 162/164 R, 164 EP, 168 N, 162/158, 168 R, 136; 8/181, 194; 428/530, 537; 260/836; 427/391, 369, 370, 395, 530, 537

[56] References Cited

U.S. PATENT DOCUMENTS

| | | | |
|---|---|---|---|
| 3,002,860 | 10/1961 | Bishop et al. | 162/168 R |
| 3,505,270 | 4/1970 | Laden | 156/187 |
| 3,732,332 | 5/1973 | Curtis et al. | 260/836 |
| 3,741,943 | 6/1973 | Sekmakas | 260/836 |
| 3,884,856 | 5/1975 | Motier et al. | 260/836 |

FOREIGN PATENT DOCUMENTS

| | | |
|---|---|---|
| 1148570 | 4/1969 | United Kingdom. |
| 1165060 | 9/1969 | United Kingdom. |
| 1290728 | 9/1972 | United Kingdom. |

*Primary Examiner*—S. Leon Bashore
*Assistant Examiner*—Peter Chin
*Attorney, Agent, or Firm*—Edward McC. Roberts

[57] ABSTRACT

A composition for the treatment of paper which improves the wet strength of paper is provided. This composition contains (a) a water-soluble mono- or binuclear hydantoin compound containing glycidyl groups, and (b) a water-soluble copolymer of maleic acid or of one of its derivatives such as maleic anhydride and of a further ethylenically unsaturated copolymerizable comonomer with 2 to 20 carbon atoms such as vinyl methyl ether, dec-1-ene, styrene and/or ethylene or a water-soluble salt of such a copolymer.

Also a process for the treatment, preferably the surface treatment of paper with the above composition is provided.

7 Claims, No Drawings

METHOD FOR TREATING PAPER WITH A COMPOSITION CONTAINING HYDANTOIN COMPOUNDS AND A COPOLYMER

The invention relates to a composition for the treatment of paper. It serves, in particular, to improve the wet strength of paper.

Paper produced in the usual way normally has an adequate tear strength in the dry state. This property is due to the hemicellulose constituents, which swell in water. In the swollen state, they bind the paper fibres loosely to one another and this bond remains intact on drying and strengthens. On wetting again, the hemicellulose particles swell again and this results in a weakening of the bonding points between the fibres. However, paper with a high wet tear strength is demanded for a number of applications, for example when the paper is converted to sacks for fertilisers, potatoes and the like, for packing flowers or frozen foodstuffs, such as fish, vegetables or ice cream, or to wallpapers, refuse bags, handkerchiefs and facial tissues and the like, and also when it is used to manufacture articles which are used outdoors, such as maps, labels, posters, notepads and programmes for sporting events.

There have already been numerous proposals for increasing the wet strength, which usually amounts to about 2–8% of the dry strength. Products based on aminoplasts, that is to say products which contain formaldehyde, are used for this purpose. Most of these and other products which can increase the wet tear strength of paper do not have good compatibility with paper additives, such as optical brighteners or starch, because of their ionic action.

The additives can either be added to the pulp or, in particular, be applied as impregnating agents to the finished paper. When added to the pulp, anionic products are effective only in the presence of aluminium ions and non-ionic products have little effect; only the addition of cationic agents to the pulp is able to increase the wet strength of the paper considerably. Such differences between anionic, non-ionic and cationic agents cannot be detected when paper webs are impregnated.

The use of an agent consisting of epoxide resins and maleic anhydride copolymers as an agent for imparting wet strength is known from U.S. Pat. No. 3,002,860. In this case, the paper is wetted with a dilute aqueous solution of 75–95% by weight of a salt obtained from a maleic anhydride copolymer, for example a styrene/-maleic anhydride copolymer, and a volatile nitrogen-containing base, such as ammonium hydroxide, and 25–5% by weight of a water-soluble polyglycidyl ether of a polyhydric alcohol, for example of ethylene glycol, and then dried at at least 88° C.

However, paper impregnated with mixtures of this type displays an unsatisfactory wet tear strength when it has come into contact with alkaline solutions, as can be seen from Table I of the said U.S. Patent Specification. Furthermore, the storage stability of this mixture at 60° C., which is important for size press application in continuous surface treatment of the paper, also leaves something to be desired.

A process for imparting wet tear strength to paper is known from U.S. Pat. No. 2,913,356 and in this process a conventional polyglycidyl ether and a curing agent for epoxide resin are added to the paper in an aqueous medium. Both the dry tear strength and the wet tear strength of paper treated in this way are inadequate. It was not to be foreseen that other compounds containing epoxide groups would show substantially better results.

It is mentioned in British Patent Specification No. 1,148,570 that hydantoins which are substituted on the N atoms by glycidyl groups can be used as crosslinking components for coating agents based on copolymers. Suitable copolymers are ternary copolymers obtained from a small amount of a free, mono-unsaturated monocarboxylic acid with a methylene group bonded to the α-C atoms, a nitrile of such an acid and an unsaturated ester. The copolymers can be employed as an aqueous dispersion or as a solution in an organic solvent and crosslinked with the hydantoins containing glycidyl groups by the action of heat. For example, coating agents of the type which can be used for finishing textiles are described with which the components are diluted with organic solvents, applied to the fabric and fixed at elevated temperature. The copolymers used are not soluble in water. Use for the treatment of paper is not mentioned. The wet tear strength of paper treated therewith is not improved.

It was the more surprising to find that the composition according to the invention is able to impart greater wet tear strength to paper.

The present invention therefore relates to a composition, for the treatment of paper, which is characterized in that it contains (a) at least one water-soluble hydantoin which contains two or more glycidyl groups and (b) at least one water-soluble copolymer, which is optionally in the form of a salt, of maleic acid or a maleic acid derivative and at least one further ethylenically unsaturated copolymerisable monomer with 2 to 20 carbon atoms.

The components (a) of the composition according to the invention are, in particular, mononuclear or binuclear hydantoin compounds which are optionally substituted in the 5-position of the hydantoin ring and contain two glycidyl groups, which are bonded direct or via a bridge member to the nitrogen atoms of the hydantoin ring.

Possible bridge members are, for example, straight-chain or, preferably, branched alkylene chains and oxyalkylene chains with 1 to 4 carbon atoms. Branched oxyalkylene chains are particularly preferred. Oxyisopropylene of the formula $—CH_2CH(CH_3)—O—$ is of primary interest. In the case of the binuclear hydantoin compounds, the two hydantoin nuclei are again preferably linked via bridge members of this type and the bridge member is optionally substituted by a glycidyl group. Accordingly, preferred binuclear hydantoin compounds contain a total of 3 glycidyl groups.

Hydantoin compounds which are substituted in the 5-position are preferred. Possible substituents in the 5-position of the hydantoin ring of the mononuclear compounds or of the hydantoin rings of the binuclear compounds are phosphonoalkylene groups which are optionally etherified by alkyl with 1 to 4 carbon atoms or, in particular, alkyl with 1 to 4 carbon atoms. Etherified phosphonalkylene groups with 2 to 6 carbon atoms in the alkylene radical, for example diethoxyphosphono-2,2-dimethyl-ethyl, are preferred.

The 5-position of the hydantoin ring or of the hydantoin rings is a rule substituted by at most one such phosphonoalkylene group.

A possible further substituent is, above all, alkyl with 1 to 4 carbon atoms, preferably isopropyl and in particular ethyl and methyl, and hydantoin compounds which are substituted in the 5-position by methyl and isopropyl or methyl and ethyl or especially by two methyl radicals are of primary interest.

Compounds which can additionally be mixed with the hydantoin compounds of the indicated type, which contain several glycidyl groups, are those which are also based on hydantoins, which contain only one glycidyl group and which are also substituted in the 5-position, preferably as mentioned above, and in the 3-position, preferably by alkyl or, in particular, hydroxyalkyl with 1 to 4 carbon atoms.

The compounds of the following formulae may be mentioned as examples of mononuclear hydantoin compounds with two glycidyl groups:

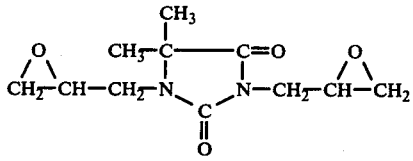

(1)

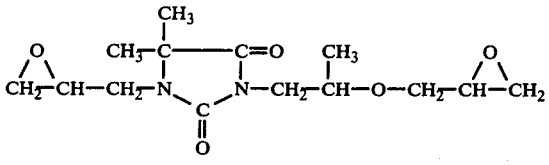

(2)

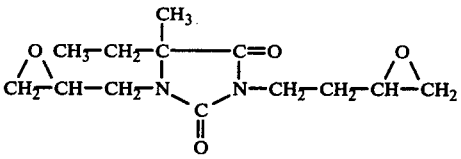

(3)

Further representatives of such mononuclear hydantoin compounds are, for example, 5-isopropyl-5-methyl-1,3-diglycidylhydantoin and 5-(diethoxyphosphono-2,2-dimethylethyl)-5-methyl-1,3-diglycidyl-hydantoin.

The compound of the formula

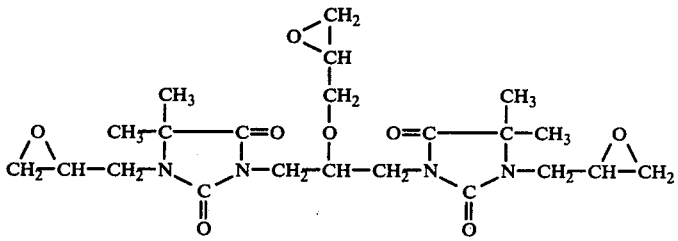

(4)

may be mentioned as an example of a binuclear hydantoin compound with two glycidyl groups.

The compound of the formula

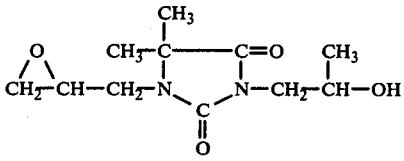

(5)

may be mentioned as an example of a mononuclear compound which contains only one glycidyl group.

The compounds of the formulae (1) to (4), which optionally are mixed with the compound of the formula (5), are preferred. A mixture of the compounds (1), (2) and, optionally, (5), above all in a weight ratio of components (1):(2) of about 7:3 or of components (1):(2):(5) of about 7:2.5:0.5 is of particular importance.

As a rule, hydantoin compounds of this type have an epoxide content of 5.5 to 8.0 epoxide group equivalents/kg.

The abovementioned hydantoin compounds are in themselves known and can be manufactured by known methods, such as are described, for example, in British Patent Specification Nos. 1,148,570, 1,165,060 or 1,290,728.

Maleic acid esters and also maleimide and, in particular, maleic anhydride are possible as the maleic acid derivative of component (b) in the composition according to the invention. The maleic acid esters are maleic acid diesters or, preferably, maleic acid monoesters of an alcohol, especially of an alcohol with 1 to 8 carbon atoms.

Compounds which can be used as comonomers with the maleic acid or with the maleic acid derivative are, above all, compounds of the formula

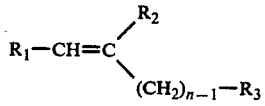

(1)

in which n denotes 1 or 2; $R_2$ denotes hydrogen, halogen or methyl; $R_3$ denotes hydrogen, halogen, alkyl or alkenyl with at most 16 carbon atoms which is optionally substituted by aryloxy or arylcarboxy, or $R_3$ denotes alkoxy with 1 to 16 carbon atoms, aryloxy, carbalkoxy of the formula —COO—alkyl, acyloxy of the formula alkyl—COO— or optionally substituted phenyl; and $R_1$ denotes hydrogen; it being possible for $R_3$ also to be nitrile if $R_2$ is halogen or methyl, and $R_1$ is hydrogen or optionally substituted phenyl if $R_3$ denotes optionally substituted phenyl.

Further preferred comonomers correspond to the formula

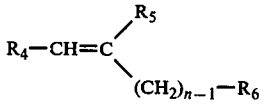

(2)

in which n denotes 1 or 2; $R_5$ denotes hydrogen, bromine, chlorine or methyl; $R_6$ denotes hydrogen, bromine, chlorine, alkyl or alkenyl with 10 to 16 carbon atoms which is substituted by arylcarboxy, or carbalkoxy or acyloxy with at most 12 carbon atoms or phenyl which is optionally substituted by ethoxy, methoxy, ethyl or methyl and $R_4$ denotes hydrogen; it being possible for $R_6$ also to be nitrile if $R_5$ is bromine, chlorine or methyl, and $R_4$ is hydrogen or phenyl which is optionally substituted by ethoxy, methoxy, ethyl or methyl if $R_6$ denotes a correspondingly unsubstituted or substituted phenyl radical, and especially to the formula

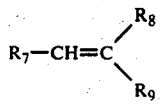

(3)

in which $R_8$ denotes hydrogen, chlorine or methyl; $R_9$ denotes hydrogen, chlorine, alkenyl with 2 to 4 carbon atoms, alkoxy or alkyl with 1 to 8 carbon atoms, carbalkoxy or acyloxy with 2 to 5 carbon atoms or phenyl and $R_7$ denotes hydrogen, it being possible for $R_9$ also to be nitrile if $R_8$ is chlorine or methyl, and $R_7$ is hydrogen or phenyl if $R_9$ denotes phenyl.

Specific representatives of the comonomers of the formula (1) which may be mentioned are, inter alia, styrene, α-methylstyrene, vinyl methyl ether, isobutyl vinyl ether, ethylene, isobutylene, hex-1-ene, dec-1-ene, isoprene, butadiene, allyl acetate, vinyl acetate, vinyl propionate, β-chloroallyl acetate, diallyl phthalate, methyl acrylate and ethyl acrylate, methacrylonitrile, methyl methacrylate and ethyl methacrylate, vinylidene chloride, vinyl chloride and cis- and trans-stilbene.

Isobutyl vinyl ether, vinyl acetate, methyl methacrylate and above all vinyl methyl ether, ethylene, dec-1-ene and especially styrene are of primary interest.

Water-soluble salts of the copolymers which can also be used as component (b) in the composition according to the invention are, for example, salts of an alkaline earth metal hydroxide or alkali metal hydroxide, especially sodium hydroxide; however, volatile nitrogen-containing bases, such as ammonium hydroxide and alkyl-aluminum hydroxides with 1 to 4 carbon atoms in the alkyl radical, for example triethylammonium hydroxide, are preferably used for salt formation.

In place of copolymers with only two monomers it is also possible to employ terpolymers, which are manufactured, for example, from monooctyl maleate/dodecyl methacrylate/styrene, monomethyl maleate/maleic anhydride/styrene, maleic anhydride/vinyl acetate/vinyl chloride, monobutyl maleate/acrylic acid/styrene and especially from maleic anhydride/isobutyl vinyl ether/styrene.

The copolymers used as component (b) in the compositions according to the invention are in themselves known and are manufactured according to known methods (compare, for example, the textbook "Organische Chemie" ("Organic Chemistry") by L. F. Fieser and M. Fieser, inter alia page 1,747 et seq., 2nd edition, 1972 reprint).

Copolymers which are obtained from maleic anhydride as a rule have an anhydride content of 100 to 250 anhydride group equivalents/kg in the case of polymers obtained from two co-components and of 250 to 350 anhydride group equivalents/kg in the case of polymers obtained from three co-components, that is to say in the case of the terpolymers.

The weight ratio, in the compositions according to the invention, of the copolymer used as component (b) to the hydantoin compound used as component (a) is 2.5:1 to 1:1 and preferably 2:1 to 1:1.

The weight ratio of 2.5:1 to 1:1 generally applies when terpolymers are used as component (b), whilst the weight ratio of 2:1 to 1:1 generally applies for copolymers obtained from only two cocomponents.

If copolymers obtained from maleic anhydride are used and their anhydride content and the epoxide content of the hydantoin compounds employed in the compositions according to the invention are taken into account, the ratio of components (a) and (b) in the compositions is 1:1 to 1:3 and preferably 1:1 to 1:2, based on the equivalent weights of (a), relative to the epoxide group content, and of (b), relative to the anhydride group content.

The mixtures which follow represent embodiments of the compositions according to the invention which are of primary interest: mixtures of 1 part by weight of a mixture of 70 parts by weight of the hydantoin compound of the formula (1) and 30 parts by weight of the hydantoin compound of the formula (2) and of 1–1.8 parts by weight of a styrene/maleic anhydride copolymer (manufactured according to known methods in a molar ratio of 1:1, for example in boiling benzene and in the presence of benzoyl peroxide); or mixtures of 1 part by weight of the hydantoin compound of the formula (4) and 1–1.5 parts by weight of a (1:1) dec-1-ene/maleic anhydride copolymer or 1–2 parts by weight of a (1:1) vinyl methyl ether/maleic anhydride copolymer, or mixtures of 1 part by weight of a mixture of 70 percent by weight of the hydantoin compound of the formula (1), 25 percent by weight of the hydantoin compound of the formula (2) and 5 percent by weight of the hydantoin compound of the formula (5) and of 1–1.5 parts by weight of a (1:1) vinyl acetate/maleic anhydride copolymer or 1–1.2 parts by weight of a (1:1) ethylene/maleic anhydride copolymer or 1–2 parts by weight of a (0.5:1) diallyl phthalate/maleic anhydride copolymer or 1–2 parts by weight of the (1:1) methyl methacrylate/maleic anhydride copolymer or 1–2.5 parts by weight of a (1:1:1) isobutyl vinyl ether/styrene/maleic anhydride terpolymer.

When the paper is treated with the compositions, according to the invention, of components (a) and (b), these can be added to the paper pulp. However, wet-strength treatment at the surface of the paper, for which the paper is impregnated with the compositions according to the invention, is preferred to this wet-strength treatment in the paper pulp.

Impregnation of the paper, which can be in the form of webs, is effected with an aqueous solution of the composition, according to the invention, of components (a) and (b). The concentration is 0.1 to 20, preferably 0.5 to 10, percent by weight, relative to the weight of paper (dry fibre), depending on the desired wet strength and the nature of the paper; in particular, solutions which have an active substance content of 0.5 to 2, and preferably of about 1, percent by weight are used.

In addition to the components (a) and (b), the compositions according to the invention preferably also contain metal complexing agents which are suitable for keeping aluminium salts in solution, since these are used in paper treatment for binding resin layers and anionic dyestuffs and also as filler retention agents.

In the case of continuous surface application in the paper industry (size press) an accumulation of alum (aluminium sulphate) in the impregnating bath must be expected.

Aqueous solutions of agents which impart wet strength and are intended for this application, and thus also the compositions according to the invention, should therefore be stable in the presence of alum, that is to say remain homogeneous and display no precipitates. Effective metal complexing agents which can be used are, for example, ethylenediaminetetraacetic acid, N'-2-hydroxyethyl-ethylenediamine-N',N'',N''-triacetic acid, nitrilotriacetic acid and the like, or the sodium salts thereof.

By virtue of the fact that they contain a metal complexing agent of this type, the compositions according to the invention are able, if necessary, to contain 1.5 times to twice the amount of the maximum amount of alum to be expected in continuous surface application without this resulting in impairment of their positive effect on the tear strength of the treated papers.

As a rule, the amount of alum to be expected is 0.5 percent by weight of the aqueous impregnating solution. In order to bind such an amount of alum by forming a complex, the impregnating solution contains 0.8–2.5, and preferably 2 to 2.2, percent by weight of a metal complexing agent.

The pH value of the impregnating solution is as a rule 4 to 14 and especially 5 to 9.

The impregnated paper is squeezed off, advantageously until an amount of 0.1 to 10, and preferably 1, percent by weight, relative to the paper, of the water-soluble substances remains on the paper.

In the paper industry, on an industrial scale, the paper is subsequently dried, for example on heated cylinders, and stored at room temperature, in a so-called maturing process, for 5 to 20 days, during which time the resin which has been applied cures completely on the paper. Under laboratory conditions, this drying and the maturing process are imitated by first drying the paper at room temperature and then subjecting it to a heat treatment at a temperature above 90° C., whereupon the resin which has been applied to the paper cures completely as in the industrial maturing process.

As a rule, drying at room temperature takes 20 to 40 minutes. The heat treatment on a laboratory scale is preferably carried out at 90° to 200° C. and especially at 100° to 140° C. for 10 to 100, and especially 15 to 40, minutes.

Although less preferred, it is also possible to apply the components (a) and (b) of the composition according to the invention separately to the paper, that is to say to impregnate the paper only with component (a) in the form of a dilute, aqueous, approximately 1% strength solution and to dry it and then to impregnate it with component (b), also in the form of a dilute aqueous solution, and to dry it and subsequently to cure the paper.

The compositions according to the invention impart advantageous high wet tear length and tear strength and dry tear length and tear strength to the paper treated therewith.

In addition, the compositions according to the invention can be stored and transported in the concentrated state. In the dilute state, they are stable on storage for up to 2 days at 60° C., that is to say they remain, in particular, unchanged during the entire continuous surface treatment.

The compositions are also resistant to alkali at pH values of up to 14.

The compositions according to the invention do not tend to yellowing. However, if optical brighteners are employed, the compatability of the compositions with the brighteners, which is based on the anionic character of the composition, is particularly advantageous.

By virtue of their compatibility with metal complexing agents, the compositions are stable to alum in the presence of such agents.

In the manufacturing instructions and examples which follow, the parts and percentages indicated are parts by weight and percentages by weight. In addition, maleic anhydride is abbreviated as MA.

MANUFACTURING INSTRUCTIONS FOR COPOLYMERS (a) MA/methyl methacrylate copolymer 245 Parts (2.5 mols) of maleic anhydride, 250 parts (2.5 mols) of methyl methacrylate and 5.5 parts of benzoyl peroxide are dissolved in 4,000 parts of benzene in an inert nitrogen atmosphere and the solution is heated to the reflux temperature of 79°–87° C. and kept at this temperature for 6 hours. After cooling the benzene reaction solution to 20° C., the copolymer is precipitated by adding 8,000 parts of methanol and separated off. After drying at 35° to 40° C. and under 15 mm Hg, 428 parts of the copolymer, which is in the form of a transparent, colourless mass which can be powdered, are obtained.

The following copolymers are manufactured in a similar way but the copolymers are precipitated without the addition of methanol by cooling the reaction solution at the end of the reaction:

(b) MA/diallyl phthalate copolymer (from 0.5 mol of diallyl phthalate per mol of MA).

(c) MA/dec-1-ene copolymer (from 1 mol of dec-1-ene per mol of MA).

(d) MA/styrene copolymer (from 1 mol of styrene per mol of MA).

(e) MA/vinyl methyl ether copolymer (from 1 mol of vinyl methyl ether per mol of MA).

(f) MA/vinyl acetate copolymer (from 1 mol of vinyl acetate per mol of MA).

(g) MA/ethylene copolymer (from 1 mol of ethylene per mol of MA, the gaseous ethylene being passed into the solution of MA in benzene).

(h) MA/isobutyl vinyl ether/styrene terpolymer (from 1 mol of isobutyl vinyl ether and 1 mol of styrene per mol of MA).

EXAMPLE 1

Paper made of pure cellulose with a weight per unit area of 200 g/m$^2$ is impregnated with a 1% strength aqueous solution of a mixture A consisting of 100 parts of the hydantoin compound of the formula (4) and 130 parts of the MA/dec-1-ene copolymer according to instructions (c) in an impregnating vat using a squeezing roll, so that 1%, relative to the paper, of the water-soluble substances remains on the paper. The measured epoxide content of the hydantoin mixture used in mixture A is 6.04 epoxide group equivalents/kg and the anhydride content of the copolymer used in mixture A is 215 anhydride group equivalents/kg. Mixture A thus has an equivalent ratio of the epoxide group content of the hydantoin mixture to the anhydride group content of the copolymer of 1:1. The aqueous solution, which contains 1% of mixture A, has a pH value of 9.0.

For practical reasons, the content of water-soluble substances which have remained on the paper is determined by weighing the paper before impregnating and immediately after squeezing off in the wet state, since weighing of the paper which has already been dried is rendered virtually impossible because of the highly hydrophilic nature of the paper.

The impregnated paper is dried for 30 minutes at room temperature and then subjected to a heat treatment at 140° C. for 30 minutes. 140 mm × 15 mm strips are cut out of this paper and weighed and subjected to a tensile stress in a tearing machine until the strip tears. The tear strength is determined dry (dry tear strength) and after storing for one hour in distilled water (wet tear strength). The results are expressed as the tear length in meters, the number of meters designating the length of the paper strip at which the strip would tear under its own weight.

The relative wet tear strength in % is the ratio of the tear length of the paper in the wet state (= W) to that in the dry state (= D) multiplied by 100, that is to say:

$$S \text{ relative} = (W \times 100)/D$$

In Table I which follows, the tear lengths and the tear strength of the paper treated according to the invention (A) are compared with those which are obtained with a paper which has been impregnated with an aqueous solution of the ammonium salt of dec-1-ene/MA copolymer (pH value = 9) without the addition of an epoxide resin (X).

The values indicated in Table I are average values from 10 measurements in each case. In order to show the significance, the 95% statistical limiting values associated therewith are given in brackets.

Table I

| Agent imparting wet strength | Dry tear length m | Wet tear length m | Relative wet tear strength % |
|---|---|---|---|
| A | 2651 (2579/2723) | 1523 (1503/1544) | 57.6 (55.2/59.9) |
| X | 2441 (2400/2482) | 1459 (1440/1478) | 59.8 (58/61.6) |

EXAMPLE 2

The procedure is as described in Example 1 but the paper is impregnated with a 1% strength aqueous solution of a mixture B consisting of 100 parts of a mixture of 70% of the hydantoin compound of the formula (1) and 30% of the hydantoin compound of the formula (2) and 147 parts of the MA/styrene copolymer according to instructions (d). Epoxide content of the hydantoin mixture: 7.47 equivalents/kg anhydride content of the copolymer: 202 equivalents/kg epoxide:anhydride equivalent ratio of mixture B: 1:1 pH value of mixture B: 9.0.

In Table II which follows, the tear length and tear strength of the paper (B) treated according to the invention are compared with those of papers, of which one is impregnated with an aqueous solution of the ammonium salt of styrene/MA copolymer on its own (pH value 9, designated Y), the second is impregnated with a mixture of 163 parts by weight of styrene/MA copolymer and 100 parts by weight of ethylene glycol diglycidyl ether ($YM_1$) and the third is impregnated with a mixture of 24 parts by weight of styrene/MA copolymer and 100 parts by weight of an epoxide resin of glycerol and epichlorohydrin with an epoxide equivalent weight of 140–160 ($YM_2$).

Table II

| Agent imparting wet strength | Dry tear length m | Wet tear length m | Relative wet tear strength % |
|---|---|---|---|
| B | 2815 (2760/2870) | 1350 (1322/1379) | 48 (46/50) |
| Y | 2582 (2556/2609) | 1216 (1196/1235) | 47.1 (45.8/48.3) |
| $YM_1$ | 2103 (2063/2143) | 774 (757/791) | 36.8 (35.3/38.3) |
| $YM_2$ | 1874 (1837/1911) | 684 (673/695) | 36.4 (35.2/37.8) |

EXAMPLE 3

The procedure is as indicated in Example 1 but the paper is impregnated with a 1% strength aqueous solution of a mixture C consisting of 100 parts of the hydantoin compound of the formula (4) (epoxide content: 6.04 equivalents/kg) and 200 parts of the MA/vinyl methyl ether copolymer according to instructions (e) (anhydride content: 156 equivalents/kg). Epoxide:anhydride equivalent ratio of mixture C: 1:2 pH value of mixture C: 5.3.

In Table III which follows, the tear lengths and tear strength of the paper (C) treated according to the invention are compared with those of papers, of which one is impregnated with an aqueous solution (pH value = 5) of vinyl methyl ether/MA copolymer (designated Z), the second is impregnated with a mixture of 200 parts by weight of vinyl methyl ether/MA copolymer and 100 parts by weight of ethylene glycol diglycidyl ether ($ZM_1$) and the third is impregnated with a mixture of 200 parts by weight of vinyl methyl ether/MA copolymer and 100 parts by weight of an epoxide resin from glycerol and epichlorohydrin with an epoxide equivalent weight of 140–160 ($ZM_2$).

Table III

| Agent imparting wet strength | Dry tear length m | Wet tear length m | Relative wet tear strength % |
|---|---|---|---|
| C | 1953 (1839/2066) | 1180 (1145/1214) | 60.4 (55.4/66) |
| Z | 2242 (2201/2283) | 1096 (1072/1120) | 48.9 (47/50.9) |
| $ZM_1$ | 1935 (1912/1958) | 742 (728/756) | 38.3 (37.2/39.5) |
| $ZM_2$ | 1934 (1915/1953) | 741 (726/756) | 38.3 (37.2/39.5) |

EXAMPLE 4

The procedure is as indicated in Example 1 but the paper is impregnated with a 1% strength solution of a mixture D consisting of 100 parts of a hydantoin mixture of 70% of the compound of the formula (1), 25% of the compound of the formula (2) and 5% of the compound of the formula (5) (epoxide content of the hydantoin mixture: 7.27 equivalents/kg) and of 92 parts of the MA/ethylene copolymer according to instructions (g) (anhydride content: 126 equivalents/kg) Epoxide:anhydride equivalent ratio of mixture D: 1:1 pH value of mixture D: 5.9.

The tear lengths and tear strength of the paper treated, according to the invention, with mixture D were determined:

dry tear length: 2653 m
wet tear length: 1214 m
relative wet strength: 45.8%

Similar results are obtained with the following mixtures E to G:

Mixture E

100 Parts of a hydantoin mixture of 70% of the compound of the formula (1), 25% of the compound of the formula (2) and 5% of the compound of the formula (5) (epoxide content of the hydantoin mixture: 7.27 equivalents/kg) and 134 parts of the MA/vinyl acetate copolymer according to instructions (f) (anhydride content: 184 equivalents/kg). Epoxide:anhydride equivalent ratio of mixture E: 1:1 pH value of mixture E: 6.1.

Mixture F

100 Parts of a hydantoin mixture of 70% of the compound of the formula (1), 25% of the compound of the formula (2) and 5% of the compound of the formula (5) (epoxide content of the hydantoin mixture: 7.27 equivalents/kg) and 161 parts of the MA/diallyl phthalate copolymer according to instructions (b) (anhydride content: 221 equivalents/kg). Epoxide:anhydride equivalent ratio of mixture F: 1:1 pH value of mixture F: 6.4.

Mixture G

100 Parts of a hydantoin mixture of 70% of the compound of the formula (1), 25% of the compound of the formula (2) and 5% of the compound of the formula (5) (epoxide content of the hydantoin mixture: 7.27 equivalents/kg) and 144 parts of the MA/methyl methacrylate copolymer according to instructions (a) (anhydride content: 198 equivalents/kg). Epoxide:anhydride equivalent ratio of mixture G: 1:1 pH value of mixture G: 6.5.

EXAMPLE 5

The procedure is as indicated in Example 1 but the paper is impregnated with a 1% strength solution of a mixture H consisting of 100 parts of a hydantoin mixture of 70% of the compound of the formula (1), 25% of the compound of the formula (2) and 5% of the compound of the formula (5) (epoxide content of the hydantoin mixture: 7.44 equivalents/kg) and 220 parts of the MA/isobutyl vinyl ether/styrene terpolymer according to instructions (h) (anhydride content: 302 equivalents/kg).

Epoxide:anhydride equivalent ratio of mixture H: 1:1
pH value of mixture H: 5.6.

The following tear lengths and tear strength were determined for the paper treated, according to the invention, with mixture H:

dry tear length: 2762 m
wet tear length: 1074 m
relative wet strength: 38.9%

EXAMPLE 6

The example shows the good storage stability of a solution of a composition according to the invention.

Operating temperatures of about 60° C. must be expected in size press application in continuous surface treatment of paper. It is important that the solutions of the agents used to impart wet strength as far as possible remain unchanged at these temperatures during the application time, so that a decrease in the wet tear strength is avoided or can be kept within narrow bounds.

Using mixture C as the agent for imparting wet strength, according to Example 3, a 2% strength aqueous solution is prepared. Part of this solution is diluted immediately with water to a solids content of 0.9% and a second part of the solution is so diluted after storing for 32 hours at 60° C. Using these solutions, the paper is impregnated in the same way as in the preceding examples and then dried for 15 minutes at 140° C. Solids contents of 1 ± 0.02% remain on the paper. In Table IV which follows, the wet tear lengths are compared with those which are obtained with a solution, prepared in the same way, of agent $ZM_1$ from Example 3:

Table IV

| Agent imparting wet strength | A Wet tear length in m before storing the agent for imparting wet strength for 32 hours at 60° C | B Wet tear length in m after storing the agent for imparting wet strength for 32 hours at 60° C | Absolute difference A−B | Percentage difference $\frac{A-B}{A} \times 100$ |
|---|---|---|---|---|
| C | 1095 (1081/1109) | 1074 (1050/1098) | 0* | 0* |
| $ZM_1$ | 755 (732/778) | 646 (633/659) | 109 | −14.4 |

*Since the 95% statistical ranges overlap, there is no significant difference.

The difference between the values for the wet tear length obtained with an agent C according to the invention and a known agent $ZM_1$ for imparting wet strength is surprising.

Similar results are obtained with mixtures A, B and D to H as agents for imparting wet strength, according to Example 1, 2, 4 and 5.

EXAMPLE 7

The example shows the good stability to alkali of the composition according to the invention.

Mixture B as an agent for imparting wet strength according to Example 2 and mixture C as an agent for imparting wet strength according to Example 3 are applied to paper in the manner described at the start of Examples 1 to 3. However, before measuring the tear length, the paper strips to be tested are not stored in water but are stored for 1 hour in aqueous sodium hydroxide solution (pH value 13.4) at 60° C.

In Table V which follows, the wet tear length of the paper strips treated in this way is compared with that determined according to Examples 2 and 3; furthermore, the corresponding wet tear length values of papers which had been impregnated with the agents, for imparting wet strength, $YM_2$ (see Example 2) and $ZM_2$ (see Example 3) are given.

Table V

| Agent for imparting wet strength | Wet tear length in m after storage in water | in sodium hydroxide solution (pH 13.4) | Difference* m | % |
|---|---|---|---|---|
| B | 1350 (1322/1379) | 1299 (1268/1330 | 0** | 0 |
| C | 1180 (1145/1214) | 1189 (1168/1210) | 0** | 0 |
| $YM_2$ | 684 (673/695) | 572 (560/584) | 112 | −16.4 |
| $ZM_2$ | 741 (726/756) | 616 (603/629) | 125 | −16.9 |

*(compare Table IV)
**95% ranges overlap

Similar results are obtained with mixtures A, B and D to H as the agents for imparting wet strength, according to Examples 1, 2, 4 and 5.

EXAMPLE 8

A 2% strength aqueous solution of mixture B as an agent for imparting wet strength according to Example 2 is prepared (for this purpose a 10% strength aqueous ammoniacal solution of the copolymer is first prepared. This has a pH value of 9).

Alum, in the form of an aqueous solution, is added in portions to the 2% strength aqueous solution of mixture B (pH value 9) until the final solution is 0.5% strength in respect of alum. A precipitate already forms after the addition of the first portions. The aqueous solution of B is thus not stable to alum and cannot be considered for use in the size press. (After the addition of alum is complete, the pH value is 5.6).

Tetra Sodium ethylenediaminetetraacetate in the form of 30% strength aqueous solution is added to the alum-containing dispersion which now exists until the final solution is 1.0% strength in respect of the complex-forming agent. The pH value of the solution is 5.7. After stirring for 15 minutes, a clear homogeneous solution which is readily suitable for impregnating purposes is again obtained.

Advantageously, the metal complexing agent is already added to the aqueous solution of the agent for imparting wet strength before the solution is used in the size press, that is to say before the aqueous impregnating solution comes into contact with alum. In this case, a finely divided precipitate first forms when alum is added but this precipitate dissolves again after stirring for 5 minutes.

Similar results are obtained with mixtures A and C to H as agents for imparting wet strength, according to Examples 1 and 3 to 5.

EXAMPLE 9

With the aid of aqueous sodium hydroxide solution, a solution of the vinyl methyl ether/MA copolymer according to instructions (e) with a solids content of 20 percent by weight is prepared. The pH value of the solution is 5.3. The solution is mixed with an equal volume of a 10% strength aqueous solution of the hydantoin compound of the formula (4) and the mixture is diluted with water to give a 2% strength solution. This solution has a pH value of 5.3. Alum, in the form of an aqueous solution, is now added in the same way as in Example 8 until the final solution contains 0.5% of alum. A precipitate forms immediately.

A clear solution is produced by means of a 30% strength aqueous solution of tetrasodium ethylenediaminetetra acetate, in the same way as described for Example 8.

The complex-forming agent can be added either before or after the addition of alum. The concentration of the complex-forming agent in the final solution is again 1%.

In these examples, the formation of a complex of alum is achieved with 200% of the complex-forming agent (amount of alum = 100%); the minimum amount is 150%.

Similar results are obtained with mixtures A, B and D to H as agents for imparting wet strength, according to Examples 1, 2, 4 and 5.

What is claimed is:

1. A process for the surface treatment of paper, comprising the steps of impregnating the paper, in an amount sufficient to impart improved wet strength to the paper, with an aqueous solution of a composition which contains (a) at least one water-soluble hydantoin which contains two or more glycidyl groups and (b) at least one water-soluble copolymer, which is optionally in the form of a salt, of maleic acid or a maleic acid derivative and at least one further ethylenically unsaturated copolymerisable comonomer with 2 to 20 carbon atoms, wherein the weight ratio of component (b) to component (a) is 2.5:1 to 1:1, squeezing off the impregnated paper, drying the impregnated paper, and then subjecting the dried paper to a heat treatment at elevated temperature.

2. A process according to claim 1, in which the impregnation is carried out with a 0.1 to 20 percent strength by weight aqueous solution of the composition and the impregnated paper is squeezed off to such an extent that 0.1 to 10 percent by weight, relative to the paper, of the composition remains on the paper.

3. A process according to claim 1, in which the impregnation is carried out with a 0.5 to 2 percent strength by weight solution of the composition and the paper is squeezed off to such an extent that 1 percent by weight of the composition remains on the paper.

4. A process according to claim 1, in which the paper is dried at room temperature for 20 to 40 minutes.

5. A process according to claim 1, in which the paper is subjected to a heat treatment at 90° to 200° C. for 10 to 100 minutes.

6. A process according to claim 1, in which the paper is first impregnated with component (a) and then with component (b) of the composition and dried and subsequently the paper is subjected to the heat treatment.

7. Paper of improved wet strength which has been surface treated by a process, comprising the steps of impregnating the paper, in an amount sufficient to impart improved wet strength to the paper, with an aqueous solution of a composition which contains (a) at least one water-soluble hydantoin which contains two or more glycidyl groups and (b) at least one water-soluble copolymer, which is optionally in the form of a salt, of maleic acid or a maleic acid derivative and at least one further ethylenically unsaturated copolymerisable comonomer with 2 to 20 carbon atoms, wherein the weight ratio of component (b) to component (a) is 2.5:1 to 1:1, squeezing off the impregnated paper, drying the impregnated paper, and then subjecting the dried paper to a heat treatment at elevated temperature.

* * * * *